US007455105B1

(12) United States Patent
McKee

(10) Patent No.: US 7,455,105 B1
(45) Date of Patent: Nov. 25, 2008

(54) APPARATUS AND METHOD FOR INSTALLING COILED TUBING IN A WELL

(76) Inventor: Jim D. McKee, 12217 Marcrest Ct., Houston, TX (US) 77070

( * ) Notice: Subject to any disclaimer, the term of this patent is extended or adjusted under 35 U.S.C. 154(b) by 212 days.

(21) Appl. No.: 11/501,505

(22) Filed: Aug. 8, 2006

Related U.S. Application Data

(60) Provisional application No. 60/706,500, filed on Aug. 8, 2005.

(51) Int. Cl.
*E21B 19/07* (2006.01)

(52) U.S. Cl. ..... 166/88.2; 166/77.2; 175/423

(58) Field of Classification Search ..... 166/382, 166/384, 385, 77.2, 77.1, 84.4, 88.2; 175/423
See application file for complete search history.

(56) References Cited

U.S. PATENT DOCUMENTS 2,338,767 A * 1/1944 Humason ..... 166/68.5
3,704,033 A * 11/1972 Arnold ..... 285/18
3,713,675 A * 1/1973 White, Jr. ..... 285/3
4,402,535 A * 9/1983 Bridges ..... 285/123.11
4,554,971 A 11/1985 Cobb
4,646,827 A 3/1987 Cobb
5,515,925 A * 5/1996 Boychuk ..... 166/379
5,515,926 A 5/1996 Boychuk
5,522,464 A * 6/1996 Piper ..... 166/77.2
5,727,631 A * 3/1998 Baker et al. ..... 166/379
6,192,981 B1 * 2/2001 Boquet et al. ..... 166/75.13
6,588,510 B2 7/2003 Card et al.
2005/0133228 A1 * 6/2005 Shampine et al. ..... 166/382
2007/0175642 A1 * 8/2007 Shampine et al. ..... 166/382

* cited by examiner

*Primary Examiner*—Jennifer H Gay
*Assistant Examiner*—Cathleen R Hutchins
(74) *Attorney, Agent, or Firm*—Kenneth A. Roddy

(57) ABSTRACT

A tubing hanger apparatus and method for installing coiled tubing in oil and gas wells utilizes a tubing head assembly having a vertical flow passage therethrough, a hydraulically operated piston in an upper portion of the flow passage; a double tapered slip cup and an annular packoff assembly in a lower portion of the flow passage, and a contractible double tapered slip assembly disposed between the piston and slip cup. The piston, in a normally raised position and the slip in a normally radially expanded position allows coiled tubing to be lowered or raised therethrough and through the slip cup and packoff assembly. The piston is lowered by hydraulic pressure to apply a vertical force that radially contracts the slip assembly to grip the tubing and support the weight thereof and the weight is transferred through the slip cup to expand the packoff assembly and seal the tubing.

9 Claims, 4 Drawing Sheets

APPARATUS AND METHOD FOR INSTALLING COILED TUBING IN A WELL

CROSS REFERENCE TO RELATED APPLICATION

This application claims priority of U.S. Provisional Application Ser. No. 60/706,500 filed Aug. 8, 2005.

BACKGROUND OF THE INVENTION

1. Field of the Invention

This invention relates generally to methods and apparatus for installing and suspending coiled tubing in an oil and/or gas well, and more particularly to a method and apparatus for installing and suspending coiled tubing utilizing a tubing hanger with a hydraulically actuated slip and sealing assembly.

2. Description of the Prior Art

Coiled tubing has gained widespread acceptance in the last decade due to its many advantages over conventional jointed tubing, including time and labor savings, pumping flexibility, elimination of leakage and leak testing, reduced formation damage, safety, etc. The operational concept of a coiled tubing system involves running a continuous string of smaller coiled tubing into a well to perform specific well servicing operations without disturbing existing completion tubulars and equipment. When servicing is complete, the small diameter tubing may be retrieved from the well and spooled onto a large reel for transport to and from work locations.

The typical procedure for hanging or suspending coiled tubing from the surface as a production or an injection string utilizes a tubing head installed above the lower master valve in which an annular tubing hanger with slips and seals is supported and blowout preventers connected above the tubing head. The typical wellhead assembly also includes an access window assembly disposed above the blowout preventers and requires that the distance from the bottom flange of the access window assembly to the tubing head lockdown screws be measured to insure that the annular hanger assembly sets completely in its hanger profile. In wraparound style hanger assemblies the hanger (with slips and seals) is placed around the coiled tubing and slowly lowered to the top of the lower set of blowout preventers rams. The hanger assembly is lowered into the hanger bowl of the tubing head and the weight of the tubing is landed on the hanger. Lockdown screws are then engaged to actuate the seal of the hanger, and the coiled tubing is rough cut through the window of the access window assembly and the blowout preventers and access window assembly are removed. A final or smooth cut is then made on the coiled tubing and it is beveled to fit an adapter and to avoid damaging adapter seals. The remaining wellhead equipment is then installed and flow lines connected. The coiled tubing is pressured up to shear out the bottom plug and the well is placed in service.

In installations having an access window assembly, it is necessary to open the access window assembly for placement of the slip and seal assembly around the coiled tubing so that it may be lowered into the tubing head, which potentially opens the annular space surrounding the coiled tubing to the pressure in the well. Also, the fact that the hanger assembly must be lowered around the coiled tubing from a point near the bottom of the access window assembly to the seating area in the tubing head, without being seen, provides a potential for improper seating of the hanger seal and actuation of its slips. Furthermore, the wrap-around slip and sealing assemblies of the hangers are inherently more likely to create sealing or slip engagement problems than seal or slip assemblies that are continuous.

There are several types of tubing hanger assemblies for suspending coiled tubing that utilize mechanical means for actuating slips or clamping jaws to hold the tubing rigidly at a predetermined position in the annulus of a wellbore. These types of hanger assemblies typically include semi-circular gripping and support members which are clamped about the tubing at a designated position and maintained clamped with a circular array of threaded rods or set screws that maintain clamping pressure to retain the tubing, and are accessible from outside of the hanger assembly. In many of these tubing hanger assemblies, the threaded rods, actuator rods, or set screws, when rotated, move the slips downward and inward to a position adjacent the tubing in gripping relationship and simultaneously, as the slips move downward and inward, they bear against a slip support cup adjacent the central bore which, in turn, compresses a packer element to expand inward into contact with the tubing thereby to seal off the annulus immediately around the coiled tubing.

Cobb, U.S. Pat. Nos. 4,554,971 and 4,646,827 discloses a tubing anchor assembly for seating and supporting coiled tubing in a tubing head, which includes as a first element, a slip assembly characterized by multiple slip segments inserted in the slip bowl of the tubing head and each provided with a beveled top face and a vertically oriented dove tail slot. As a second element, slip retainer screws are radially threaded in the tubing head body at spaced intervals, each of the slip retainer screws provided with a frustro conical tip having a beveled tip base, and each tip extending into the slip bowl of the tubing head and engaging a dove tail slot in one of the slip segments. The slip segments are maintained in open configuration inside the upper portion of the slip bowl when the tips of the slip retainer screws are in engagement with the dove tail slots and when the slip retainer screws are threadedly retracted in the tubing head body. A retainer ring located in a groove provided in each of the slip segments serves to maintain the slip segments in a desired alignment as a slip assembly inside the slip bowl and the slip segments are permitted to drop in concert by the influence of gravity from the frustro conical tips of the slip retainer screws as the slip retainer screws are caused to threadedly travel toward the center of the slip bowl. The slip segments are secured in functional position in the slip bowl after release by engagement of the frustro conical tips with the beveled top faces of the slip segments.

Boychuk, U.S. Pat. Nos. 5,515,925 and 5,515,926 disclose an apparatus and method for suspending coiled tubing in a well which utilizes a tubing head having a vertical flow passage therethrough, an annular sealing assembly carried in a lower counterbored portion of the flow passage, and a slip assembly carried in an upper counterbored portion of the flow passage, and a plurality of circumferentially spaced threaded slip activators carried by the tubing head and connected with the slip assembly. The slip activators are manipulated externally of the tubing head to move the slip assembly from passive positions to active positions. The activators move the slip assembly between an outwardly expanded passive position in which the slip assembly does not interfere with the flow passage and an inwardly contracted active position in which gripping surfaces carried on the slip assembly engages the coiled tubing to support the weight thereof, and the weight of the tubing is transferred from the slip assembly to the sealing assembly.

Piper, U.S. Pat. No. 5,522,464 discloses a hanger assembly for use with coiled tubing, which provides separate hydraulic actuation of slip positioning and setting of a dual packer element. The hanger assembly includes a body member having an axial bore that intersects at an intermediate position with a frusto conical slip bowl wherein a spaced array of upwardly toothed slips is slidably positioned. Plural hydraulic actuators are mounted in the body member and have actuator rods pivotally connected to respective slips to be driven downward and inward into contact with the tubing at a designated position. The lower part of the body member includes a central, cylindrical cavity which receives inner and outer packers in a concentric array with the inner packer defining the central bore such that application of hydraulic fluid under pressure expands the packer inward into sealing relationship around the tubing passing therethrough.

Baker et al, U.S. Pat. No. 5,727,631 discloses a coiled tubing hanger including a hanger bowl, a slip bowl supported in the hanger body, a plurality of slip segments disposed in the slip bowl so as to be movable between a retracted position wherein the tubular member is able to pass through the coiled tubing hanger and an extended position wherein a serrated surface of the slip segments engages the coiled tubing and forces the slip segments along the slip bowl so as to wedge the slip segments between the slip bowl and the coiled tubing to hold the coiled tubing. The slip segments are biased in the retracted position with a pair of slip retaining rings and the slip segments are moved between the retracted portion and the extended position with a plurality of spring-loaded pins disposed through the hanger body and engagable against the outer side of the slip segments such that the slip segments are disposed in the extended position when the pins are urged inwardly and such that the slip segments are biased in the retracted position when the pins are urged outwardly.

Card et al, U.S. Pat. No. 6,588,510 discloses a coil tubing hanger system and method of installation utilizing a tubing hanger body having an axial opening therethrough. A slip bowl having a base and housing a slip that can be retained in a first position spaced apart from bowl base and a second position proximate the bowl base is fitted within the opening. Tubing is fitted within the slip and through the bowl while the slip is retained in the first position. The slip is then allowed to drop to the second position such that the slip teeth bite onto the outer surface of the tubing.

The present invention is distinguished over the prior art in general, and these patents in particular by a tubing hanger apparatus and method for installing coiled tubing in an oil and/or gas well which utilizes a tubing head assembly having a vertical flow passage therethrough, a hydraulically operated activation piston carried in an upper portion of the flow passage, a double tapered slip cup and an annular packoff sealing assembly carried in a lower portion of the flow passage, and a contractible double tapered slip assembly disposed between the piston and the slip cup. The piston is in a normally raised position and the slip assembly is normally radially expanded to allow and coiled tubing to be lowered or raised therethrough and through the slip cup and packoff sealing assembly. The piston is lowered by hydraulic pressure to apply a vertical force and radially contract the slip assembly to grip the tubing and support the weight thereof and the weight of the tubing is transferred through the slip cup to the packoff sealing assembly which expands inwardly to seal the tubing exterior.

In the installation method, the coiled tubing hanger assembly, which includes the tubing head and components described above, is installed on the wellhead prior to lowering the coiled tubing into the well. A blowout preventer stack and coiled tubing injector apparatus is installed above the tubing hanger apparatus. The coiled tubing is run through the blowout preventer stack and coiled tubing head until the string of coiled tubing reaches a desired depth in the well. The activation piston is subjected to hydraulic fluid pressure, such as via a hand pump, sufficient to engage and contract the slip assembly radially inwardly to engage and grip the exterior of the coiled tubing. The coiled tubing is lowered such that the weight of the tubing string is totally supported by the slip assembly, and the slip assembly is engaged with the annular packoff sealing assembly such that the weight of the tubing is transferred through the slip cup to the packoff sealing assembly which expands inwardly to form a sealing relation on exterior of the coiled tubing.

Once all the weight has been set on the slip assembly, the hydraulic pressure is increased sufficient to set and maintain the slip assembly and packoff sealing ring engaged on the tubing. The blowout preventer stack is disconnected from the tubing hanger assembly and lifted with the coiled tubing injector head, and the tubing is cut off above the tubing hanger assembly. A positive lock mandrel/reentry guide threadedly engaged in the top of the tubing head is screwed down to engage the piston and lock the piston and slip assembly in their engaged position on the tubing. The rest of the wellhead is then connected on top of the tubing hanger assembly, and the hydraulic pressure is bled off. To pull the coiled tubing string, hydraulic pressure is applied, and the positive lock mandrel/reentry guide is removed. When the coiled tubing has been re-established to the pulling coiled tubing string and a pressure test has been carried out, then the pressure is bled off to release the slips and packoff seal.

In the present invention, the slips are held in the open position via a set of expansion rings that can be collapsed when hydraulic pressure has been applied via the hydraulically activated piston and have a "controlled makeup" to control the amount of pressure applied to the tubing so they will not crush the coiled tubing, which would otherwise "neck the tubing down" and weaken it at the suspension point.

The apparatus and method of the present invention allows the use of coiled tubing for production applications without requiring removal of the tubing injector apparatus or blowout preventers and without requiring the use of an access window assembly. The present apparatus and method also provides complete pressure control of the well at all times. The slip and seal assemblies are contained within the coiled tubing head but are activated by an external source of hydraulic pressure, and may be easily expanded and contracted to allow the coiled tubing to be repositioned, lower or higher in the well, without pulling the tubing.

SUMMARY OF THE INVENTION

It is therefore an object of the present invention to provide a method and apparatus for installing and suspending coiled tubing in an oil and/or gas well that allows the use of coiled tubing for production applications without requiring disconnection of the tubing injector apparatus or blowout preventers and without requiring the use of an access window assembly.

It is another object of this invention to provide a method and apparatus for installing and suspending coiled tubing in an oil and/or gas well that provides complete pressure control of the well at all times.

Another object of this invention is to provide a method and apparatus for installing and suspending coiled tubing in an oil and/or gas well which utilizes internal slip and seal assemblies that are contained within the coiled tubing head but are activated externally via hydraulic pressure.

A further object of this invention is to provide a method and apparatus for installing and suspending coiled tubing in an oil and/or gas well which allows the slip assembly to be retracted to an active position for allowing the coiled tubing to be repositioned, lower or higher in the well, without pulling the tubing.

A still further object of this invention is to provide an apparatus for installing and suspending coiled tubing in an oil and/or gas well which is simple in construction, inexpensive to manufacture and is rugged and reliable in operation.

Other objects of the invention will become apparent from time to time throughout the specification and claims as hereinafter related.

The above noted objects and other objects of the invention are accomplished by the present method and apparatus for installing coiled tubing in an oil and/or gas well, particularly for production of hydrocarbon fluids therefrom. The tubing hanger apparatus includes a tubing head assembly having a vertical flow passage therethrough, a hydraulically operated activation piston carried in an upper portion of the flow passage, a double tapered slip cup and an annular packoff sealing assembly carried in a lower portion of the flow passage, and a contractible double tapered slip assembly disposed between the piston and the slip cup. The piston is in a normally raised position and the slip assembly is normally radially expanded to allow and coiled tubing to be lowered or raised therethrough and through the slip cup and packoff sealing assembly. The piston is lowered by hydraulic pressure to apply a vertical force and radially contract the slip assembly to grip the tubing and support the weight thereof and the weight of the tubing is transferred through the slip cup to the packoff sealing assembly which expands inwardly to seal the tubing exterior.

In the installation method, the coiled tubing hanger assembly, which includes the tubing head and components described above, is installed on the wellhead prior to lowering the coiled tubing into the well. A blowout preventer stack and coiled tubing injector apparatus is installed above the tubing hanger apparatus. The coiled tubing is run through the blowout preventer stack and coiled tubing head until the string of coiled tubing reaches a desired depth in the well. The activation piston is subjected to hydraulic fluid pressure, such as via a hand pump, sufficient to engage and contract the slip assembly radially inwardly to engage and grip the exterior of the coiled tubing. The coiled tubing is lowered such that the weight of the tubing string is totally supported by the slip assembly, and the slip assembly is engaged with the annular packoff sealing assembly such that the weight of the tubing is transferred through the slip cup to the packoff sealing assembly which expands inwardly to form a sealing relation on exterior of the coiled tubing.

Once all the weight has been set on the slip assembly, the hydraulic pressure is increased sufficient to set and maintain the slip assembly and packoff sealing ring engaged on the tubing. The blowout preventer stack is disconnected from the tubing hanger assembly and lifted with the coiled tubing injector head, and the tubing is cut off above the tubing hanger assembly. A positive lock mandrel/reentry guide threadedly engaged in the top of the tubing head is screwed down to engage the piston and lock the piston and slip assembly in their engaged position on the tubing. The rest of the wellhead is then connected on top of the tubing hanger assembly, and the hydraulic pressure is bled off. To pull the coiled tubing string, hydraulic pressure is applied, and the positive lock mandrel/reentry guide is removed. When the coiled tubing has been re-established to the pulling coiled tubing string and a pressure test has been carried out, then the pressure is bled off to release the slips and packoff seal.

Many other objects and advantages of the apparatus and method of the present invention will be apparent from reading the description which follows in conjunction with the accompanying drawings.

DESCRIPTION OF THE PREFERRED EMBODIMENTS

Figure 1:
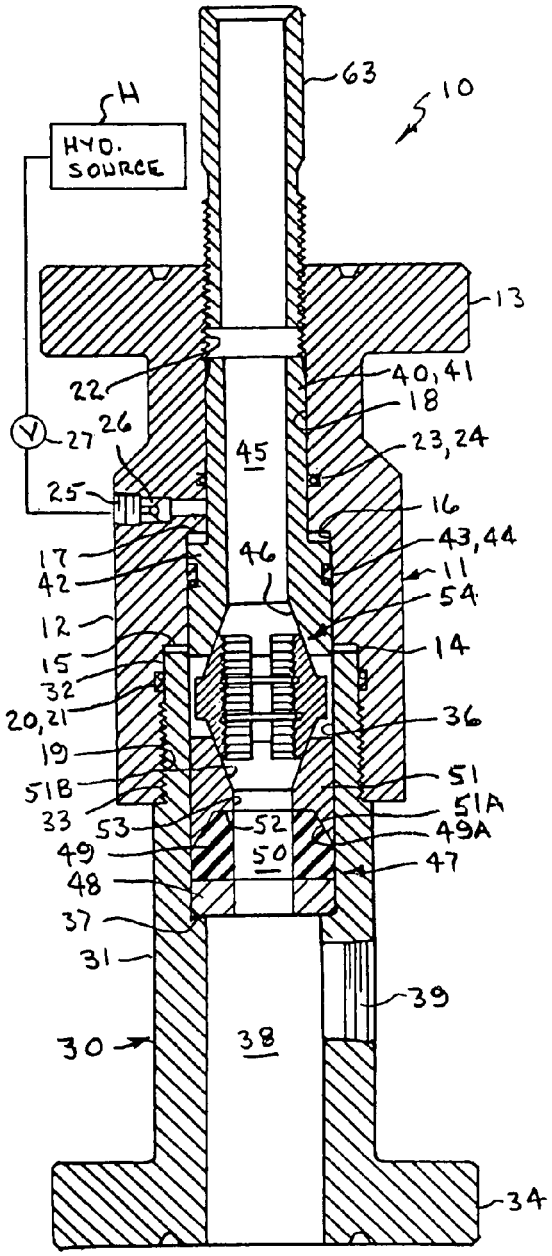
FIG. 1 is a longitudinal cross section of a coiled tubing hanger apparatus in accordance with a preferred embodiment of the invention showing the components in a disengaged non-sealing condition to allow coiled tubing to be lowered or raised therethrough.
Figure 2:
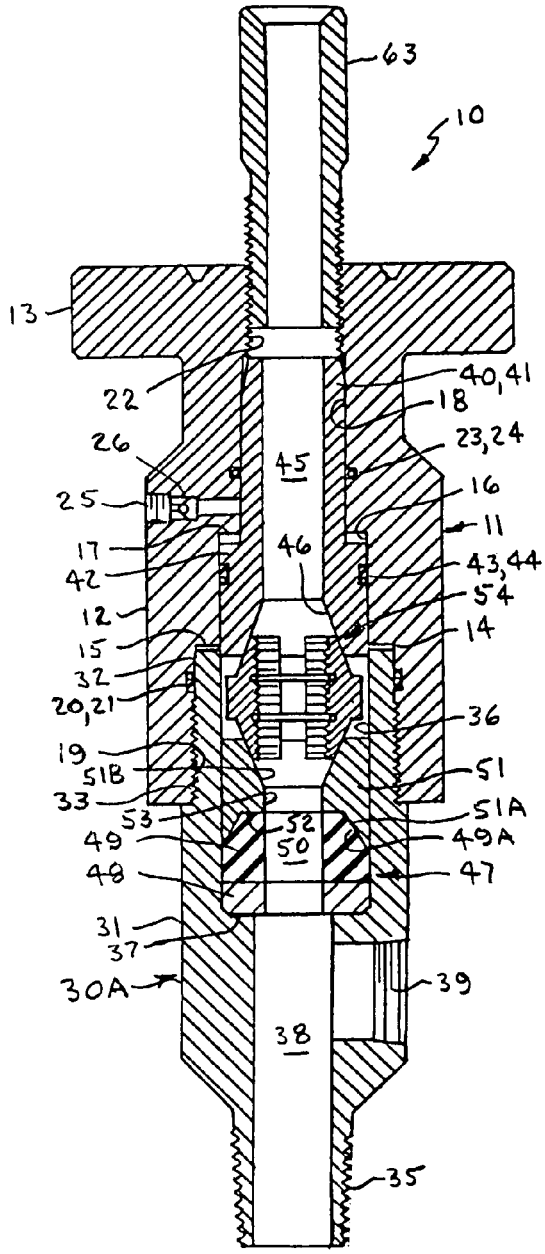
FIG. 2 is a longitudinal cross section of the coiled tubing hanger apparatus similar to FIG. 1, but having an alternate lower body portion, with the components in a disengaged non-sealing condition to allow coiled tubing to be lowered or raised therethrough.
Figure 4:
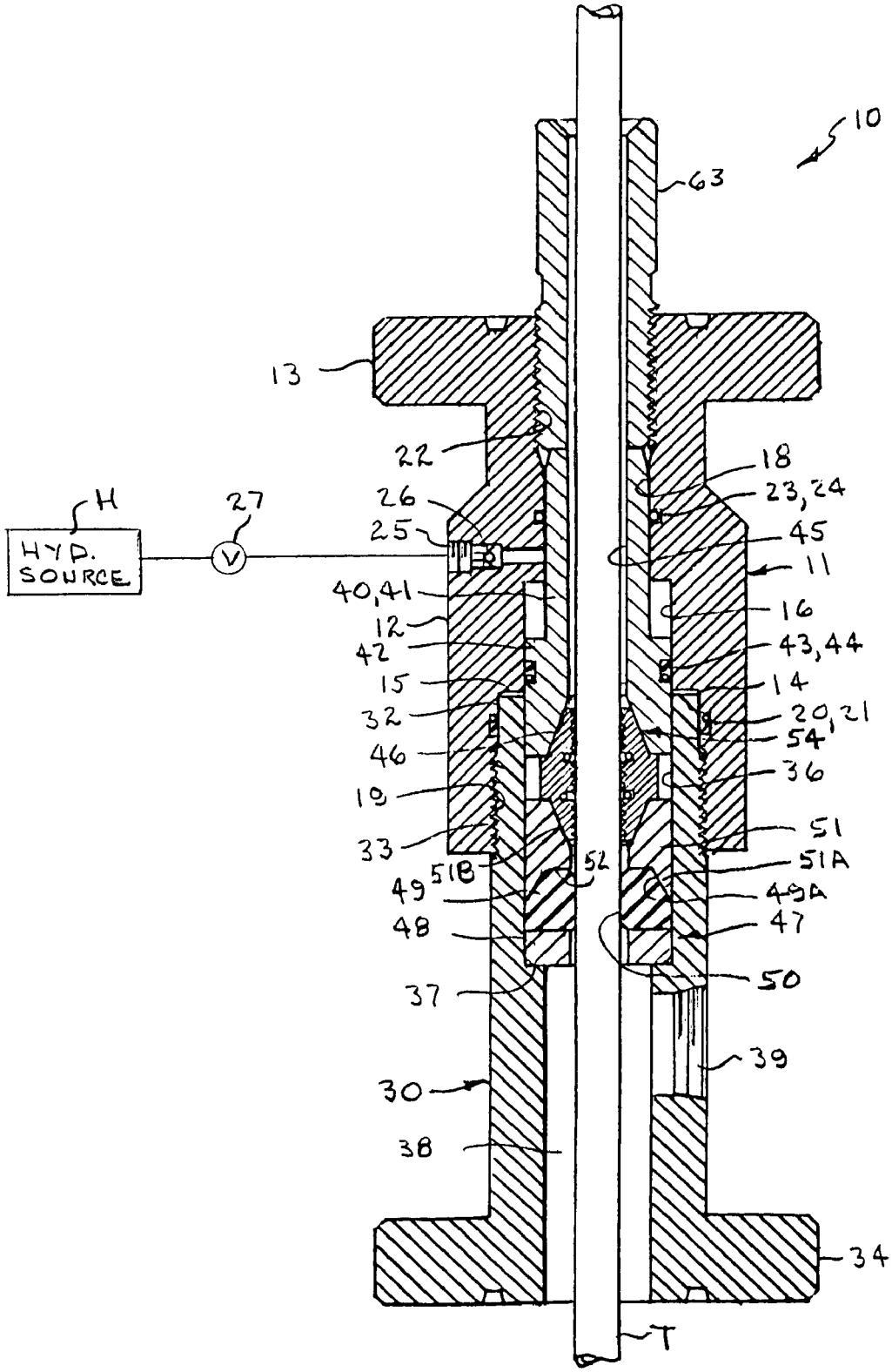
FIG. 4 is a longitudinal cross section of the coiled tubing hanger apparatus, showing the components in their engaged sealing condition on the coiled tubing and locked in that position by a positive lock mandrel/reentry guide installed in the top of the hanger apparatus.

Referring to the drawings by numerals of reference, there is shown in FIGS. 1, 2 and 4, a coiled tubing hanger assembly 10 in accordance with a preferred embodiment of the invention. The coiled tubing hanger assembly 10 includes a tubing head having an upper body member 11 and a lower body member 30 (FIGS. 1 and 4) or 30A (FIG. 2) releasably connected together. The upper body member 11 has a generally cylindrical main body portion 12 with radial flange 13 at its top end. The interior of the upper body member 11 has a first or larger bore 14 extending inwardly a distance from its bottom end and terminating in a first flat annular shoulder 15, a second intermediate bore 16, smaller in diameter than the first bore, extending inwardly a distance from the first shoulder and terminating in a second annular shoulder 17, and a third smaller bore 18, smaller in diameter than the intermediate bore, extending upwardly from the second shoulder.

The first or larger bore 14 has internal threads 19 extending upwardly a distance from its bottom end and terminating a distance below the first shoulder 15. An annular groove 20 is formed in the side wall of the larger bore 14 between the threaded portion 19 and the shoulder 14 and receives a sealing member 21, such as a polypak seal, an O-ring, or other suitable seal element. The upper end of the third or smaller bore 18 is provided with internal threads 22 that extend downward a distance from the top end of the upper body member 11. An O-ring groove 23 is formed in the side wall of the smaller bore 18 between the threaded portion and the shoulder 17 and receives an O-ring 24, an O-ring with backup ring, or other suitable seal element. A fluid port 25 disposed between the shoulder 17 and the O-ring groove and seal 23, 24, extends through the side wall of the upper body member 11 in fluid communication between the smaller bore 18 and the exterior of the upper body member.

A first check valve 26, shown schematically, is installed in the fluid port 25 to allow one-way fluid flow from a hydraulic fluid source H through the port into the interior of the upper body member 11, and, in a preferred embodiment a second check valve 27 is disposed exterior of the port between the hydraulic fluid source and the first valve to provide a double barrier from well pressure.

The exterior of the lower body member 30 has a generally cylindrical main body portion 31 with a reduced diameter neck portion 32 at its upper end and an externally threaded portion 33 extending a distance downward from the neck portion. In the embodiment of FIG. 1, the bottom end of the lower body member 30 is provided with a radial flange 34. Alternatively, as shown in FIG. 2, the lower end of the lower body member 30A is provided with a reduced diameter externally threaded portion 35. The interior of both lower body members 30 and 30A are essentially the same, and the internal features are identified by the same numerals of reference.

The interior of the lower body member 30, 30A, has a larger upper bore 36 extending inwardly a distance from its top end and terminating in an annular shoulder 37, and a smaller lower bore 38, smaller in diameter than the upper bore, extending downwardly from the shoulder 37 and terminating at the bottom end of the lower body member. An outlet port 39 disposed beneath the shoulder 37 extends through the side wall of the lower body member to provide fluid communication between the lower bore 38 and the exterior of the lower body member when the coiled tubing is supported therein.

In the assembled condition, the externally threaded portion 33 of the lower body member 30 is threadedly engaged in the internal threads 19 in the lower end of the upper body member 11 with its reduced diameter neck portion 32 engaged in sealing relation with the seal member 21.

A generally cylindrical activation piston 40 is slidably disposed in the upper body member 11. The activation piston 40 has a smaller diameter upper portion 41 engaged in a sliding seal relation with the seal member 24, and a larger diameter lower portion having a circumferential groove 43 containing a sealing element 44, such as a polypak seal or other suitable seal, engaged in a sliding seal relation with the interior of the intermediate bore 16. The interior of the activation piston 40 has a longitudinal bore 45 that extends downwardly from its top end and terminates in a downward and outward tapered conical bottom portion 46.

A packoff seal assembly 47 is disposed at the bottom of the larger upper bore 36 of the lower body member 30, 30A. The packoff seal assembly 47 has a metal base ring 48 supported on the shoulder 37 and a rubber seal ring 49 secured to the base ring. The exterior of the rubber seal ring 49 has an upward and inwardly tapered truncated conical upper portion 49A. A central bore 50 extends through the packoff assembly, through which the coiled tubing is lowered or raised.

A slip support cup 51 is slidably received in the larger upper bore 36 of the lower body member 30, 30A and supported on the top of the packoff assembly 47. The interior of the slip support cup 51 has a lower conical surface 51A that tapers upward and inwardly from its bottom end and terminates in a radial shoulder 52, and an upper conical surface 51B that tapers downward and inwardly from its top end and terminates in a central bore 53 that extends through the radial shoulder 52 and through which the coiled tubing passes. The lower conical surface 51A surrounds the tapered conical upper portion 49A of the rubber seal ring 49 of the packoff assembly 47 in a mating relation and the radial shoulder 52 is supported on the top surface of the seal ring.

Figure 3A:
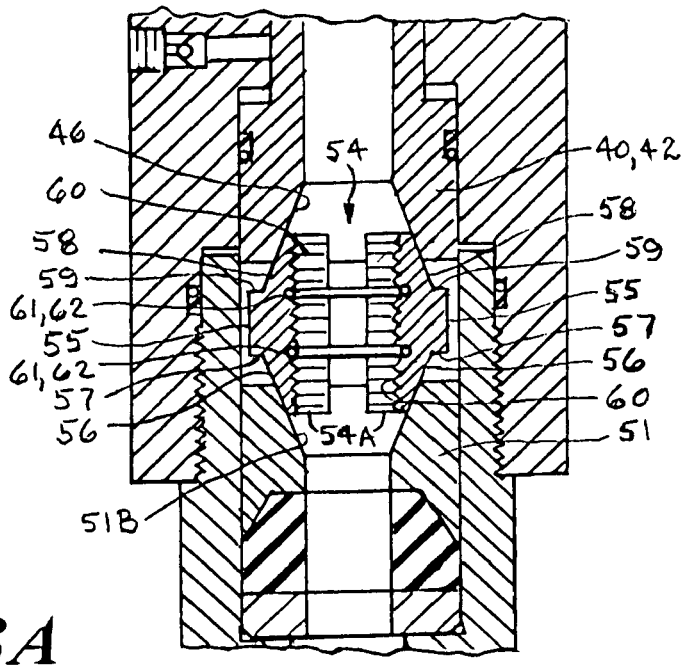
FIG. 3A and FIG. 3B are partial longitudinal cross sections, showing the slip assembly in the open position, and in the engaged position, respectively.

Referring additionally to FIG. 3A, a contractible double tapered segmented slip assembly 54 having at least two separate slip segments 54A is disposed in the tubing hanger assembly 10 between the slip support cup 51 and the activation piston 40. Each slip segment 54A has an arcuate or semi-circular radial flange 55 intermediate its top and bottom ends, a lower frusto-conical surface 56 that tapers upward and outwardly from its bottom end and terminates in a radial shoulder 57 at the bottom of the flange, and an upper conical surface 58 that tapers downward and outwardly from its top end and terminates in a radial shoulder 59 at the top of the flange. The interior surface of each slip segment 54A is provided with an arcuare inner surface that is toothed to provided a gripping surface 60 and a pair of vertically spaced recessed grooves 61. An expansion ring 62 is installed in each groove 61 to maintain them in a normally radially expanded open position, as shown in FIGS. 1, 2 and 3A.

As shown in FIGS. 1, 2 and 3A, when the piston 40 is raised and the slip assembly 54 is in the expanded position, the lower frusto-conical surfaces 56 of the slip segments 54A are supported in the upper portion of the upper conical surface 51B of the slip cup 51, and their upper frusto-conical surfaces 58 are received in the lower portion of the conical bottom portion 46 of the raised piston 40. In this position, the gripping surfaces 60 of the slip segments 54A are spaced apart a sufficient distance to allow the coiled tubing string to run through the hanger assembly without engaging the slips and setting the slips accidentally.

As shown in FIGS. 1, 2 and 4, an externally threaded tubular positive lock mandrel/reentry guide 63 is threadedly engaged in the threads 22 at the upper end of the upper body member 11, and is partially retracted to be spaced above the top end of the raised piston 40 when the slip assembly 54 is in the expanded position, and the tubing is being run.

Figure 3B:
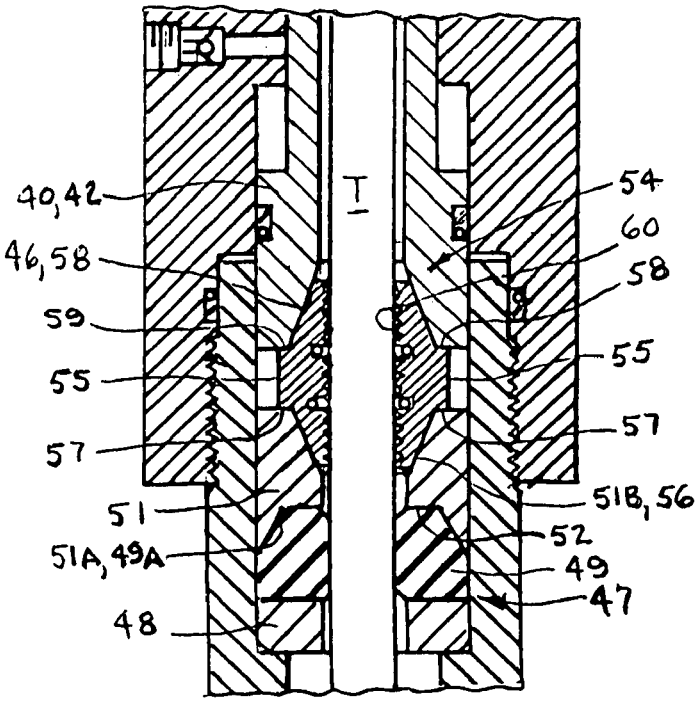

FIG. 3B and FIG. 4 show the coiled tubing T in the vertical flow passage defined by the bores in the positive lock mandrel/reentry guide 63, the piston 40, slip cup 51, packoff assembly 47, and the lower body member 30, 30A. The slip assembly 54 and sealing ring 49 of the packoff assembly 47 are shown engaged on the coiled tubing T, and the positive lock mandrel/reentry guide 63 is shown screwed down to lock the piston and slip assembly in their engaged position, as described hereinafter.

The activation piston 40 is activated by a hydraulic hand pump or other hydraulic power source H connected to the fluid port 25 and the hydraulic fluid passes through the check valve 26 in the fluid port. Preferably a second check valve 27 is disposed between the hydraulic power source and the first check valve 26 to provide a double barrier from well pressure. When sufficient hydraulic pressure is applied to the activation piston 40, it moves down, and the upper and lower frusto-conical surfaces 58 and 59 of the slip segments 54A are engaged between the conical bottom portion 46 of the piston and the upper conical surface 51B of the slip cup 51, and they contract radially inward against the force of the expansion rings 62 to close around the coiled tubing T such that their gripping surfaces 60 bite into and firmly grip the tubing.

It should be noted that, as shown in FIG. 3B, the radial shoulders 57 and 59 of the slip segments 54A are engaged between the flat bottom surface of the piston 40 and the flat top surface of the slip cup 51, and thus, control the amount of squeeze that can be put on the coiled tubing. This feature prevents the slip segments from imposing stress risers and compressive forces larger than needed to grip and hold the coiled tubing, and thereby prevents necking down of the coiled tubing, and weakening it at the suspension point. This feature is called a "controlled make-up" of the slips. The opposed double taper on the exterior of the slip segments 54A facilitates engagement of the gripping surfaces along the full length of the slips, and thus reduces the overall length required to hold the tubing weight.

The mating conical surfaces of the piston 40, the slip assembly 54, the slip cup 51 and the sealing ring 49 of the packoff assembly 47 are correlated such that when the slip assembly is contracted and engaged on the tubing, the weight of the tubing is transferred through the slip cup to the sealing ring of the packoff assembly to compress the sealing ring such that it deforms to form a sealing relation between the exterior of the coiled tubing and the surrounding surfaces of the lower body member 30, 30A of the tubing head assembly. Because the slip assembly is hydraulically set from an external source (such as a hydraulic hand pump), the slips can be set and sealed anytime it is required, and can be expanded and contracted to allow the coiled tubing to be repositioned, lower or higher in the well, without pulling the tubing.

In order to retract (raise) the piston 40, all hydraulic pressure and fluid is released from the pump or hydraulic power source connected with the fluid port so that the piston will retract (be raised) when the coiled tubing is pulled (removed). When the coiled tubing is pulled, the piston 40 is raised and the expansion rings 62 expand the slip segments 54A such that the slip segments are reset and the slips and piston resume their original positions. The cross sectional surface areas of the piston are of a balanced design such that it is not affected, or moved, by internal pressure, due to the differential in surface area.

Operation

Figure 5:
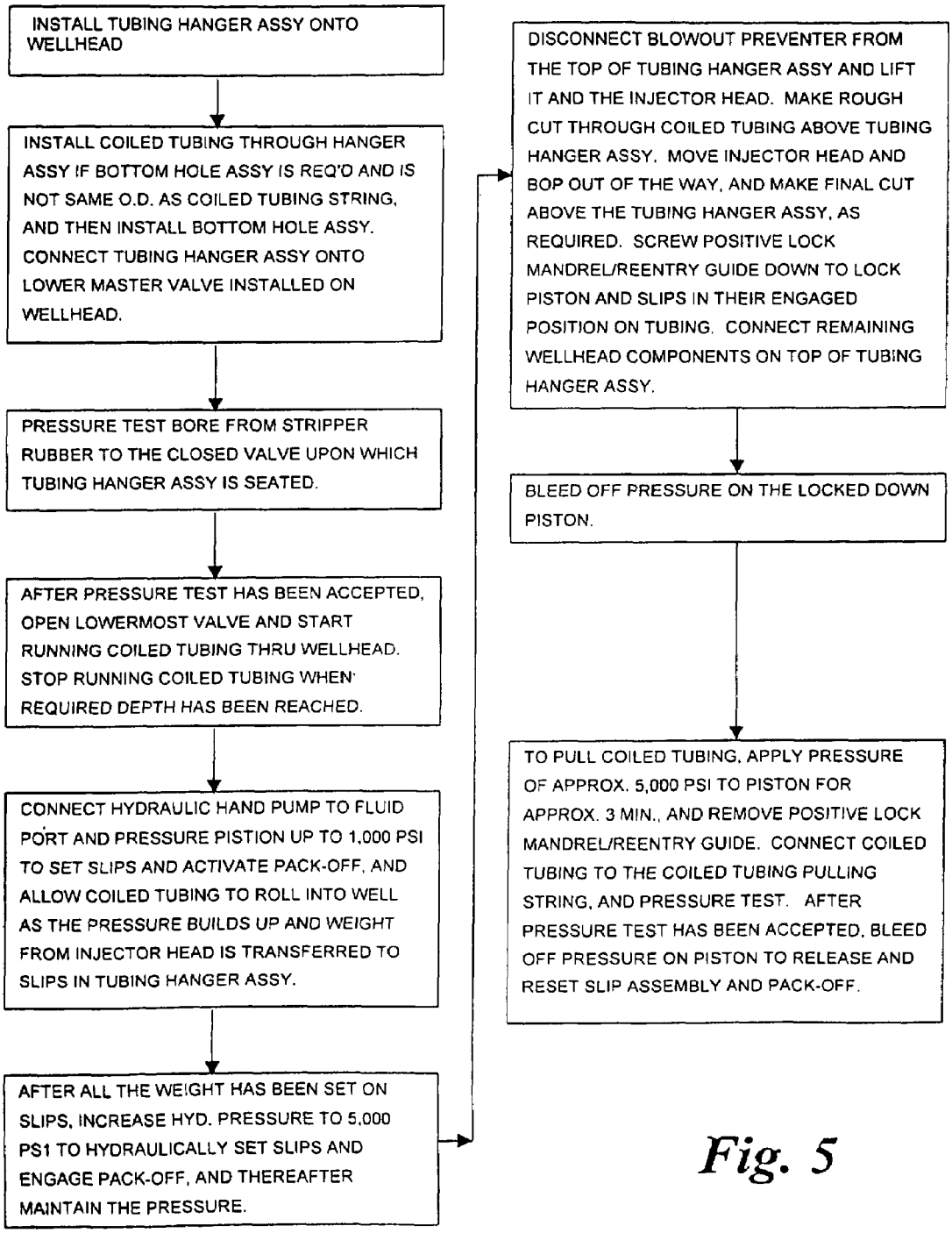
FIG. 5 is a block diagram illustrating the steps in a typical procedure for running and suspending coiled tubing using the present tubing hanger assembly.

Having described the components of the system, and referring additionally to FIG. 5, the steps in a typical procedure for running and suspending coiled tubing using the tubing hanger assembly will be described.

The tubing hanger assembly 10 is installed onto the wellhead, making sure that the correct, preferably new, ring gaskets are installed in the top and bottom flanges; or if installing a threaded hanger assembly, that an acceptable thread dope is applied.

If a bottom hole assembly is required and is not the same O.D. as the coiled tubing string, it may be necessary to install the coiled tubing through the hanger assembly, and then install the bottom hole assembly. The tubing hanger assembly 10 is nippled up (connected) onto the lower master valve that is installed on the wellhead.

The bore from the striper rubber (sealing element used for the coiled tubing) to the closed valve upon which the tubing hanger is seatedis pressure tested to the pressure required.

Once the pressure test has been accepted, the lowermost valve is opened and the coiled tubing is run thru the wellhead, and running is stopped when the required depth has been reached.

To set the slip assembly 54 and activate the packoff assembly 47, a hydraulic hand pump is connected to the fluid port 25 on the tubing hanger assembly. The activation piston 40 is pressured up to approximately 1,000 PSI and the coiled tubing is allowed to roll into the well as the pressure builds up on the port. There should be a slow transfer of weight from the existing injector head to the internal slip assembly 54 in the tubing hanger assembly. Once all the weight has been set on the slip assembly 54, the hydraulic pressure is increased to approximately 5,000 PSI. The increased pressure will hydraulically set the slip assembly 54 and engage packoff assembly sealing ring 49. The internal one-way check valve 26 in the fluid port 25 maintains the pressure on the slip assembly and the packoff seal so that it cannot accidentally be bled off.

The blowout preventer (BOP) is nippled down (disconnected) from the top of the tubing hanger assembly 10. The BOP and the coiled tubing injector head is lifted to a sufficient distance to where a rough cut can be made through the tubing approximately 6" above the tubing hanger assembly 10. Once the injector head and BOP have been moved out of the way, a final cut of 4" (or whatever length may be required) above the tubing hanger assembly is made. The positive lock mandrel/reentry guide 63 is screwed down to engage the top end of the activation piston 40 and lock the piston and slip assembly 54 in their engaged position on the tubing. The rest of the wellhead is then nippled up (connected) on top of the tubing hanger assembly.

Since the activation piston 40 is mechanically locked down, the pressure on the fluid port 25 should be bled off. This will eliminate any possibility that heat generated by friction flow will cause an increase in the pressure of the fluid in the closed cavity used to set the slips and packing.

To pull the coiled tubing string, a pressure of approximately 5,000 PSI is applied through the fluid port of the tubing hanger assembly for approximately three minutes. Only after this step can the positive lock mandrel/reentry guide 63 be removed. When the coiled tubing has been reestablished to the pulling coiled tubing string and the pressure test has been carried out, then the fluid port pressure should be bled off to release the slips and packoff.

The present coiled tubing hanger assembly has minimum leak paths, whereas other hangers have three or six external activation methods via activation screws or hold down screws, which are all potential leak paths. The present hanger assembly can also be set without having any service personnel underneath the blowout preventers (BOPS) which would be nippled up (connected) on top of the tubing hanger. The reduced leak paths and the ability to hydraulically set the slips provide significant advantages of the present coiled tubing hanger over conventional coiled tubing hanger apparatus and installation methods used in the coiled tubing industry.

While this invention has been described fully and completely with special emphasis upon preferred embodiments, it should be understood that within the scope of the appended claims the invention may be practiced otherwise than as specifically described herein.

The invention claimed is:

1. Hanger means for installing and suspending coiled tubing in an oil and/or gas well, comprising:

a tubing head adapted to be mounted on a wellhead of the well and having a vertical passage therethrough;

a hydraulically operated activation piston disposed in an upper portion of said vertical passage in a sliding seal relation for vertical movement therein between a raised position and a lowered position, said piston having a central longitudinal bore extending downward from a top end and an adjoining downward and outward tapered conical lower end portion through which the coiled tubing may be raised and lowered;

a fluid entry port disposed in fluid communication between the exterior of said tubing head and said vertical passage and said piston for connection to a source of hydraulic fluid for moving said piston between said raised and said lowered positions;

an annular sealing assembly supported in a lower portion of said vertical passage including a continuous annular seal member having a central bore through which the coiled tubing may be raised and lowered, and an exterior with an upwardly and inwardly truncated conical upper portion, said sealing member capable of deforming when a vertical force is applied thereto to form a sealing relation between surrounding surfaces of said tubing head and the exterior of the coiled tubing;

a slip support cup slidably disposed in said vertical passage having an interior with a lower conical surface that tapers upward and inwardly from a bottom end terminating in a radial shoulder, an upper conical surface that tapers downward and inwardly from a top end terminating in a central bore that extends through said radial shoulder, and through which the coiled tubing may be raised and lowered, said lower conical surface and radial shoulder supported on said seal member conical upper portion;

a contractible double tapered slip assembly disposed between said piston conical lower end portion and said slip support cup upper conical surface including slip segments having an exterior with an upwardly and inwardly tapered frusto-conical upper portion and a downwardly and inwardly tapered frusto-conical lower portion, said slip segments movable between a radially outward expanded position allowing the coiled tubing to be raised and lowered therethrough and a radially inward contracted position engaged on the coiled tubing; wherein said activation piston, when subjected to sufficient hydraulic fluid pressure from a source exterior of said tubing head, is moved to its said lowered position to engage said slip assembly between said piston conical lower end portion and said slip support cup upper conical surface and contract said slip segments radially inwardly to grip and support the weight of the coiled tubing and the weight of the tubing is transferred from said slip assembly through said slip support cup to said sealing member to apply a vertical force thereto deforming said seal member to form a sealing relation between the exterior of the coiled tubing and surrounding surfaces of said tubing head.

2. The hanger means according to claim 1, further comprising:

check valve means in communication with source of hydraulic fluid and said fluid entry port to allow one-way fluid flow from the source of hydraulic fluid source through said port into said vertical passage.

3. The hanger means according to claim 1, wherein said tubing head comprises an upper body member and a lower body member releasably connected together, said upper body member having a generally cylindrical main body portion with an internally threaded bottom end and a radial flange at a top end;

said lower body member having a generally cylindrical main body portion with an externally threaded upper end sealingly engaged in said upper body internally threaded bottom end.

4. The hanger means according to claim 3, wherein said lower body member has an externally threaded portion lower end.

5. The hanger means according to claim 3, wherein said lower body member has a radial flange at a bottom end.

6. The hanger means according to claim 3, wherein said upper body member has a central larger first bore extending inwardly a distance from said upper body member bottom end and terminating in a first flat annular shoulder, internal threads extending upwardly a distance from its said bottom end and terminating a distance below said first shoulder, and first annular seal means disposed between said internal threads and said first shoulder, a second intermediate bore smaller in diameter than said first bore extending inwardly a distance from said first shoulder and terminating in a second annular shoulder, and a third bore smaller in diameter than said intermediate bore extending upwardly from said second shoulder, said third bore having an internally threaded upper end extending downward a distance from said upper body top end, and second annular seal means disposed between said internally threaded upper end and said second annular shoulder;

said fluid entry port is disposed between said upper body second annular shoulder and said second annular seal means;

said lower body member has a generally cylindrical main body portion with a reduced diameter neck portion at an upper end, an externally threaded portion extending a distance downward from said neck portion, a larger upper bore extending inwardly a distance from a top end and terminating in an annular shoulder, and a smaller lower bore smaller in diameter than said upper bore extending downwardly from said annular shoulder and terminating at a bottom end of said lower body member, and an outlet port disposed beneath said annular shoulder extending to the exterior of said lower body member to provide fluid communication between said lower bore and the exterior of said lower body member when the coiled tubing is supported is said slip assembly;

said lower body member externally threaded portion is threadedly engaged in said internal threads in the lower end of said upper body member with its said reduced diameter neck portion engaged in sealing relation with said first annular seal means; and said vertical passage defined by said bores in said upper body member and said lower body member.

7. The hanger means according to claim 6, wherein said activation piston comprises a generally cylindrical body having a smaller diameter upper portion engaged in a sliding seal relation with said upper body second annular seal means and a larger diameter lower portion having circumferential seal means engaged in a sliding seal relation with said upper body member intermediate bore.

8. The hanger means according to claim 6, wherein said annular sealing assembly is disposed in said lower body member larger upper bore and supported on said annular shoulder at the terminal end thereof, and said continuous annular seal member exterior capable of deforming when a vertical force is applied thereto to form a sealing relation between said lower body member larger upper bore and the exterior of the coiled tubing.

9. The hanger means according to claim 8, wherein said slip support cup is slidably disposed in said lower body member larger upper bore.

* * * * *